US009818273B2

(12) United States Patent
Nekoogar et al.

(10) Patent No.: US 9,818,273 B2
(45) Date of Patent: Nov. 14, 2017

(54) SECURE PASSIVE RFID TAG WITH SEAL

(71) Applicants: Faranak Nekoogar, San Ramon, CA (US); Matthew Reynolds, Seattle, WA (US); Scott Lefton, Melrose, MA (US); Farid Dowla, Castro Valley, CA (US); Richard Twogood, San Diego, CA (US)

(72) Inventors: Faranak Nekoogar, San Ramon, CA (US); Matthew Reynolds, Seattle, WA (US); Scott Lefton, Melrose, MA (US); Farid Dowla, Castro Valley, CA (US); Richard Twogood, San Diego, CA (US)

(73) Assignee: Dirac Solutions, Inc., Pleasanton, CA (US)

( * ) Notice: Subject to any disclaimer, the term of this patent is extended or adjusted under 35 U.S.C. 154(b) by 77 days.

(21) Appl. No.: 14/695,991

(22) Filed: Apr. 24, 2015

(65) Prior Publication Data

US 2015/0310715 A1 Oct. 29, 2015

Related U.S. Application Data

(60) Provisional application No. 61/984,841, filed on Apr. 27, 2014.

(51) Int. Cl.
*G08B 13/24* (2006.01)
*G08B 13/06* (2006.01)

(52) U.S. Cl.
CPC ..... *G08B 13/06* (2013.01)

(58) Field of Classification Search
None
See application file for complete search history.

(56) References Cited

U.S. PATENT DOCUMENTS 4,262,284 A * 4/1981 Stieff ..... G09F 3/0376 340/507
4,321,930 A * 3/1982 Jobsis ..... A61B 5/0059 600/344

(Continued)

OTHER PUBLICATIONS

United States Enrichment Corporation USEC 651: Good Handling Practices for Uranium Hexafluoride pp. 47-48 Published 1995 Bethesda, MD.

(Continued)

*Primary Examiner* — Quan-Zhen Wang
*Assistant Examiner* — Chico A Foxx
(74) *Attorney, Agent, or Firm* — Scott Lefton

(57) ABSTRACT

A secure passive RFID tag system comprises at least one base station and at least one passive RFID tag. The tag includes a fiber optic cable with the cable ends sealed within the tag and the middle portion forming an external loop. The loop may be secured to at least portions of an object. The tag transmits and receives an optical signal through the fiber optic cable, and the cable is configured to be damaged or broken in response to removal or tampering attempts, wherein the optical signal is significantly altered if the cable is damaged or broken. The tag transmits the optical signal in response to receiving a radio signal from the base station and compares the transmitted optical signal to the received optical signal. If the transmitted optical signal and the received optical signal are identical, the tag transmits an affirmative radio signal to the base station.

38 Claims, 8 Drawing Sheets

(56) References Cited

U.S. PATENT DOCUMENTS

H595 H * 3/1989 Lafaw ..... G02B 6/25 174/50
5,031,981 A * 7/1991 Peterson ..... G02B 6/3887 385/56
5,097,253 A * 3/1992 Eschbach ..... G06K 19/07749 340/545.1
5,202,673 A * 4/1993 Conrad ..... F16K 37/0058 137/551
5,656,996 A * 8/1997 Houser ..... G08B 13/1454 340/539.1
6,069,563 A * 5/2000 Kadner ..... G08B 13/06 340/539.1
6,262,664 B1 7/2001 Maloney
6,320,509 B1 * 11/2001 Brady ..... B65D 25/205 340/572.7
7,135,973 B2 11/2006 Kittel
7,274,293 B2 * 9/2007 Bradus ..... E05B 45/005 340/427
7,471,203 B2 12/2008 Worthy
7,474,209 B2 * 1/2009 Marsilio ..... E05B 45/005 340/568.1
7,636,047 B1 12/2009 Sempek
7,936,266 B2 5/2011 Francis
8,446,278 B2 5/2013 Ivashin
9,088,372 B2 * 7/2015 Goldner ..... H04B 10/85
2001/0022552 A1 9/2001 Maloney
2004/0057691 A1 * 3/2004 Doss ..... G02B 6/25 385/134
2005/0231365 A1 * 10/2005 Tester ..... G06K 19/07798 340/568.1
2006/0067697 A1 * 3/2006 Aizpuru ..... H04B 10/40 398/135
2006/0109115 A1 * 5/2006 Bradus ..... E05B 45/005 340/568.2
2006/0168644 A1 * 7/2006 Richter ..... G06F 17/30876 726/2
2006/0202824 A1 9/2006 Carroll
2007/0090921 A1 * 4/2007 Fisher ..... G07C 9/00103 340/5.73
2007/0096906 A1 * 5/2007 Lyons ..... G06K 19/0717 340/572.1
2007/0164863 A1 * 7/2007 Himberger ..... G06K 17/0029 340/572.1
2007/0207284 A1 9/2007 McClintic
2008/0013888 A1 * 1/2008 Barnes ..... G02B 6/3887 385/53
2008/0256991 A1 * 10/2008 Goldman ..... E05B 39/00 70/57.1
2008/0309487 A1 * 12/2008 Chao ..... G08B 13/06 340/542
2009/0111393 A1 * 4/2009 Scalisi ..... B29C 45/14639 455/90.1
2011/0074582 A1 * 3/2011 Alexis ..... G08B 13/149 340/572.1
2011/0244798 A1 * 10/2011 Daigle ..... H04L 63/08 455/41.2
2012/0144885 A1 * 6/2012 Mills ..... E05B 39/005 70/57.1
2013/0064509 A1 * 3/2013 Byer ..... G02B 6/3818 385/72
2014/0109631 A1 * 4/2014 Asquith ..... E05B 45/005 70/15
2014/0243442 A1 * 8/2014 Coles ..... B29C 44/445 521/143
2014/0322452 A1 * 10/2014 Kasyanova ..... G02B 1/04 427/520
2015/0015393 A1 * 1/2015 McCuen ..... G08B 25/008 340/526
2015/0043308 A1 * 2/2015 Maas ..... G01V 1/20 367/37
2015/0108300 A1 * 4/2015 Poplawski ..... G06K 19/0776 248/205.3
2015/0254961 A1 * 9/2015 Brandl ..... G06K 19/07372 340/663
2016/0356963 A1 * 12/2016 Liu ..... G02B 6/3821
2016/0356964 A1 * 12/2016 Liu ..... G02B 6/3869

OTHER PUBLICATIONS

IEEE Antennas and Propagation Magazine, vol. 51, No. 2 Joshua D. Griffin and Gregory D. Durgin Complete Link Budgets for Backscatter-Radio and RFID Systems p. 20, Section 5.15, Figs. 7a, 7b Publication Date Apr. 2009 New York, NY.

51st International Symposium Elmar-2009 Davor Vinko, Tomislav Švedek, Marijan Herceg Effects of power consumption and modulation of the passive RFID tag on the transmission range of backscattered signal Published Sep. 28, 2009 Zadar, Croatia.

Xerify Kelly Stark Best Practice Guild for RFID on Metal Tags pp. 6-13 Published Sep. 27, 2011 Aditionally, Hong Kong.

* cited by examiner

SECURE PASSIVE RFID TAG WITH SEAL

RELATED APPLICATIONS

This patent application claims the benefit under 35 USC 119(e) of U.S. Provisional Patent Application No. 61/984,841, filed on Apr. 27, 2014 and entitled "Secure Passive RFID Tag With Seal", the entirety of which is incorporated herein by reference.

CONTRACTUAL ORIGIN OF THE INVENTION

The United States Government has rights in this invention pursuant to Contract DE-AC52-07NA27344 between the United States Department of Energy and Lawrence Livermore National Security, LLC, for the operation of Lawrence Livermore National Laboratory.

FIELD OF THE INVENTION

This invention relates to passive RFID tags used to secure physical objects against tampering, and more particularly, to anti-tamper seals employing both passive RFID devices for battery-free communications, and fiber optic cables for tamper detection.

DESCRIPTION OF THE RELATED ART

Containers of sensitive, valuable and/or dangerous materials such as radioactive and fissile materials must be securely monitored to verify location and also container condition, including unauthorized opening and seal tampering. The use of RFID tags to monitor such containers is well known in the art. In the simplest form, such an RFID tag may consist of a substrate upon which a tuned antenna is formed, and an integrated circuit electrically connected to the antenna. This integrated circuit typically contains a unique identifying number, and circuitry that uses incoming RF energy at the antenna's tuned frequency to produce a back-scattered signal containing this number. Tamper detection may be provided by forming the substrate and antenna with a frangible region and affixing the tag to the container such that any tampering with the container causes permanent damage to the antenna and renders the tag incapable of transmitting a signal. Such a monitoring means is simple and has the advantage of not requiring a battery, but is extremely limited in capability. The limitations include low signal range, low data capacity and no data security, as well as constraints in how the tag can be affixed to the container to provide seal monitoring. Possibly the most critical limitation is that the tamper result is a loss of signal, rather than any positive means of tamper notification.

Seal and enclosure integrity sensors using damage to a fiber optic element to detect tampering are also well known in the art. U.S. Pat. No. 8,446,278 entitled SECURITY MONITOR FOR DOORS teaches a security monitor for container doors which include locking rods, with a fiber optic loop to monitor door locking integrity. However, while the '278 monitor can include some means for broadcasting detection of a tamper incident, this broadcasting is not secure, and the '278 monitor is still a battery powered device.

U.S. Pat. No. 8,013,744 entitled RADIO FREQUENCY IDENTIFICATION (RFID) SURVEILLANCE TAG teaches an RFID tag designed for mounting on containers of radioactive and fissile materials, and incorporating sensors to monitor tampering and other environmental conditions.

However, the '744 RFID tag is battery operated, and much of the sensor function inside the tag is dedicated to battery management. The long-term utility of the '744 tag is thus limited by battery life, and there is a need for field service to supply fresh batteries at intervals of time. There is also no mention of any use of secure communications between the '744 tag and other wireless devices. Additionally, the '744 tag lacks any means to monitor the integrity of features that the tag body is not directly attached to.

U.S. Pat. No. 7,936,266 entitled Shipping Container Seal Monitoring Device, System And Method teaches a seal device for a shipping container, wherein a portion of the device is affixed to a shipping container, and a cable which may be conductive or containing optical fibers is configured to engage with an element such as a door. Attempts to breach the door will cause damage to the cable and a disruption of any signal present in the cable. Other sensors such as acoustic sensors may also be used to detect intrusion or tampering attempts. The '266 device also teaches the use of active RFID and a microprocessor or microcontroller, and does teach the use of encryption for all data input and output. However, the '266 device does not teach the use of passive RFID, and in fact the active RFID is taught as merely one of several active transceiver options. Further, the fiber optic cable is taught as part of a cable structure having a steel cable reinforcing element, thereby making malicious cutting more difficult but consequently preventing any field-trimming of the cable to an optimal length. Often when fiber optic monitoring cables are taught for use in tamper monitoring of transport containers, the cables are armored or reinforced for enhanced durability. Further, while the use of a fiber optic cable is taught, there is no enabling mechanical detail for either the transmitting or receiving end of the fiber optic cable.

U.S. Pat. No. 7,636,047 entitled Apparatus For Monitoring A Mobile Object Including A Partitionable Strap teaches a tracking bracelet having either active or passive RFID, an optical fiber embedded in the strap for tamper detection, length trimming of the strap and optical fiber, and the use of sensors. While there is no explicit mention of a microprocessor in the apparatus, the sophistication of the disclosed sensors strongly implies the presence of a microprocessor and thus this patent is seen as implicitly disclosing the use of a microprocessor along with the sensors. However, while the use of optical fibers for tamper detection and the trimming of straps containing optical fibers are both taught, there is no enablement taught for the combination of these two features. Further, no encryption or encoding of signals is taught.

U.S. Pat. No. 7,135,973 entitled Tamper Monitoring Article, System and Method teaches an article generally formed as a strap, where one strap end may be attached to a substrate or to the other strap end to form an anti-tamper strap. Both active and passive RFID are taught, but the fiber optic cable is configured exclusively as a continuous loop, with no facility for inserting or trimming one end to optimize the fit of the anti-tamper feature. Further, neither sensors nor microprocessors or microcontrollers are taught, nor is the use of any encryption.

U.S. Patent Application No. 20060202824 entitled Electronic seal and method of shipping container tracking teaches an active RFID tag having a security cable containing a fiber optic cable. A microprocessor is also taught, although there are no sensors. The cable is taught as being of a fixed length, without any option to trim it to an optimal length during installation. There is also no suggestion to use encoding or encryption in any signal transmission. While one option taught is that of a fiber optic cable, the use of the RFID in combination with the fiber optic cable is lacking enablement.

A secure RFID tag with greater utility would provide entirely battery-free operation and secure radio signal reception and transmission, would incorporate a fiber optic tamper prevention cable with adjustable length and secure optical signal transmission and reception, would be environmentally sealed, would be configured for field attachment and installation on a container, and would incorporate sensors to monitor environmental parameters within and around the tag.

SUMMARY OF THE INVENTION

The secure passive RFID tag system of the present invention comprises at least one base station, and at least one RFID tag having means for receiving radio signals from the base station and for transmitting radio signals to the base station, where the tag is powered exclusively by received radio energy. The tag has a fiber optic cable comprising a first end, a second end, and a middle portion therebetween, wherein the first and second ends are sealed within the tag and the middle portion forms an external loop. The loop is adapted to be secured to, around or through at least portions of an object. The tag includes means for transmitting an optical signal through the fiber optic cable, and means for receiving the optical signal. The fiber optic cable is frangible and therefore easily damaged or broken in response to removal or tampering attempts, wherein the optical signal is detectably altered if the fiber optic cable is damaged or broken. The tag transmits the optical signal in response to receiving a radio signal from the base station, and the tag has means for comparing the transmitted optical signal to the received optical signal. If the transmitted optical signal and the received optical signal are approximately identical, the tag transmits an affirmative radio signal to the base station.

Further, the tag includes means for attachment to an object, where the means of attachment may be an adhesive, which may be an adhesive tape. The tag is capable of receiving and transmitting radio signals while attached to a metal substrate of substantially greater area than the area of the tag.

Still further, the tag includes an environmentally sealed enclosure formed at least in part from a radio-transparent polymer, wherein the first and second ends of the fiber optic cable are environmentally sealed within the tag. The second end of the fiber optic cable is configured to be field inserted and environmentally sealed into the tag. If the transmitted optical signal and the received optical signal are not identical, the tag may transmit an alarm radio signal to the base station. The second end of the fiber optic cable may be removed and then reinserted into the tag without damage to the fiber optic cable. The system may further comprise means for authorizing a permitted removal and subsequent reinsertion of the second end of the fiber optic cable without a resultant alarm signal. This means for authorizing removal and subsequent reinsertion may be limited by parameters which may include length of time, specific time interval, the tag receiving an authorization code, the base station receiving an authorization code, a physical key being used with the tag, and a physical key being used with the base station. The second end of the fiber optic cable may be permanently inserted and sealed into the tag such that any attempt to remove the fiber optic cable will cause damage to the fiber optic cable. The fiber optic cable may have a poly methyl methacrylate core and be not armored, thereby facilitating field-trimming and increasing tamper sensitivity, and may be field-trimmed to a desired final length in order to optimize secure attachment and to reduce the risk of accidental damage or successful tampering via excess cable length. Alternatively, the fiber optic cable may be environmentally rugged and high temperature resistant, with an optical core made from materials which may include high temperature resistant optical polymers, quartz, and glass, and a jacket made from materials which may include high temperature resistant polymers and metals.

Yet still further, the tag further comprises an aperture providing access to an optical transmitter or receiver recessed within the tag, wherein the second end of the fiber optic cable is insertable into the optical transmitter or receiver, which has a twist-lock means for aligning and retaining the second fiber optic cable end. The twist-lock means is exclusively accessible through the aperture, and is at least partially tubular with an outer surface at least partially comprising grip enhancing features which may include conical portions, ridges, knurls, high-friction texture, conformal material, and high-friction material. The system further comprises a twist-lock tool for insertion into the aperture, engaging the outer surface, and actuating the twist-lock means. The twist-lock tool further comprises a substantially cylindrical body having a center axis, a handle end and an engaging end, with a longitudinal slot traversing at least the engaging end portion of the body, with the slot having a width greater than the diameter of the fiber optic cable and a depth encompassing the center axis, thereby rendering at least a portion of the center axis substantially hollow. The engaging end has an outer diameter less than the width of the aperture, and has an internal surface at least partially comprising grip enhancing features which may include conical portions, ridges, knurls, high-friction texture, conformal material, and high-friction material, such that the grip enhancing features of the engaging end and the grip enhancing features of the twist-lock means are sufficiently matched to provide mutual grip enhancement, whereby the twist-lock tool may be held by the handle and used to grip and engage the twist-lock means in order to lock or unlock the second end at the optical transmitter or receiver without interfering with or damaging the optical fiber.

Additionally, the tag may comprise a microcontroller or microprocessor, and encrypted radio signals received by the tag are decrypted and radio signals sent by the tag are encrypted. The optical signal may comprise at least one random number, a single bit of data, a relatively small number of bits of data, or an encrypted message such as an encryption of a clock/timer signal. The optical signal may comprise an infra-red signal. The tag may also comprise signal processing and conditioning circuitry and at least one sensor selected from the group consisting of temperature sensors, radiation sensors, light level sensors, humidity sensors, vibration sensors, accelerometers, and gyroscopes, wherein the tag may transmit a radio signal comprising tamper status data and sensor data to the base station.

Still additionally, the tag further comprises a parasitic patch type antenna with a transmission range of at least 6 meters.

Yet still additionally, the base station may comprise multiple base stations, which may be a mixture of fixed base stations and mobile base stations, and the multiple base stations may be networkable in order to increase geographic area coverage and allow communication with the tag from multiple vantage points. The tag may also comprise multiple tags, wherein the means for transmitting an optical signal, the means for receiving an optical signal, and the fiber optic cable in combination form a fiber optic link, and the fiber optic link in one of the tags is interconnected to the fiber optic link in at least one other of the tags, whereby the optical signal is passed along the fiber optic cables in a ring.

OBJECTS AND FEATURES OF THE INVENTION

It is an object of the present invention to provide battery-free remote monitoring of an object such as a container versus intrusion, theft or tampering.

It is another object of the present invention to monitor a potentially openable portion of the object.

It is still another object of the present invention that such remote monitoring be protected against spying or eavesdropping.

It is yet another object of the present invention to transmit monitoring status and data signals.

It is a further object of the present invention that at least portions of the monitoring hardware be configured for installation and adjustment in the field.

It is a still further object of the present invention to be environmentally sealed.

It is a feature of the present invention to provide a secure passive RFID tag powered exclusively by radio signals, that includes a fiber optic loop attachable as a security seal to an object such as a container.

It is another feature of the present invention that in response to a received radio signal, the secure passive RFID tag transmits an optical signal through the fiber optic loop, receives the optical signal and compares the transmitted optical signal to the received optical signal, and if the transmitted optical signal matches the received optical signal, transmits an affirmative radio signal to the base station.

It is still another feature of the present invention to optionally include signal processing and conditioning circuitry and at least one sensor of types and functions including temperature, radiation, light level, humidity, vibration, acceleration, and gyroscopic orientation, in order to measure environmental parameters within or in proximity to the secure passive RFID tag, which can then process and transmit the sensor data.

It is yet another feature of the present invention that the secure passive RFID tag receives encrypted signals from at least one base station, decrypts the received signals, and transmits encrypted signals back to the base station.

It is a further feature of the present invention to include an environmentally sealed enclosure composed at least in part of radio-transparent molded polymer, which may be attached to an object such as a container with an adhesive.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE PREFERRED EMBODIMENTS

Figure 1:
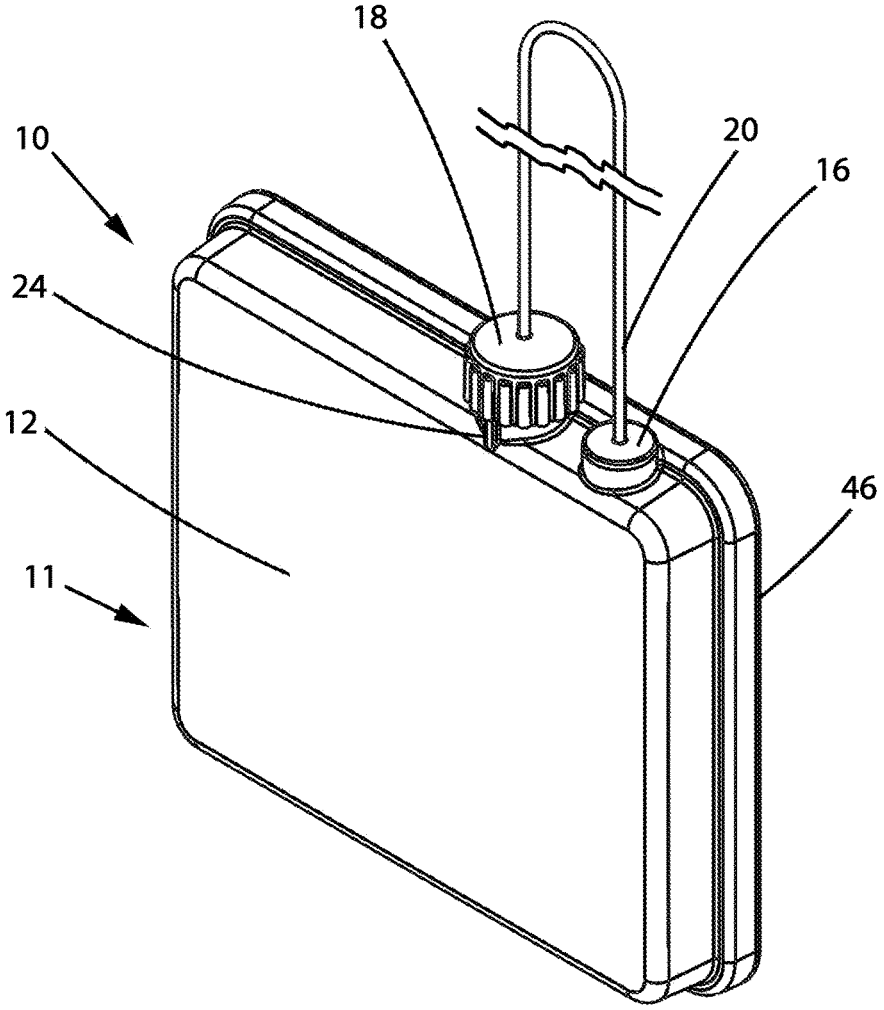
FIG. 1 shows a perspective view of the secure RFID tag with fiber optic cable.
Figure 2:
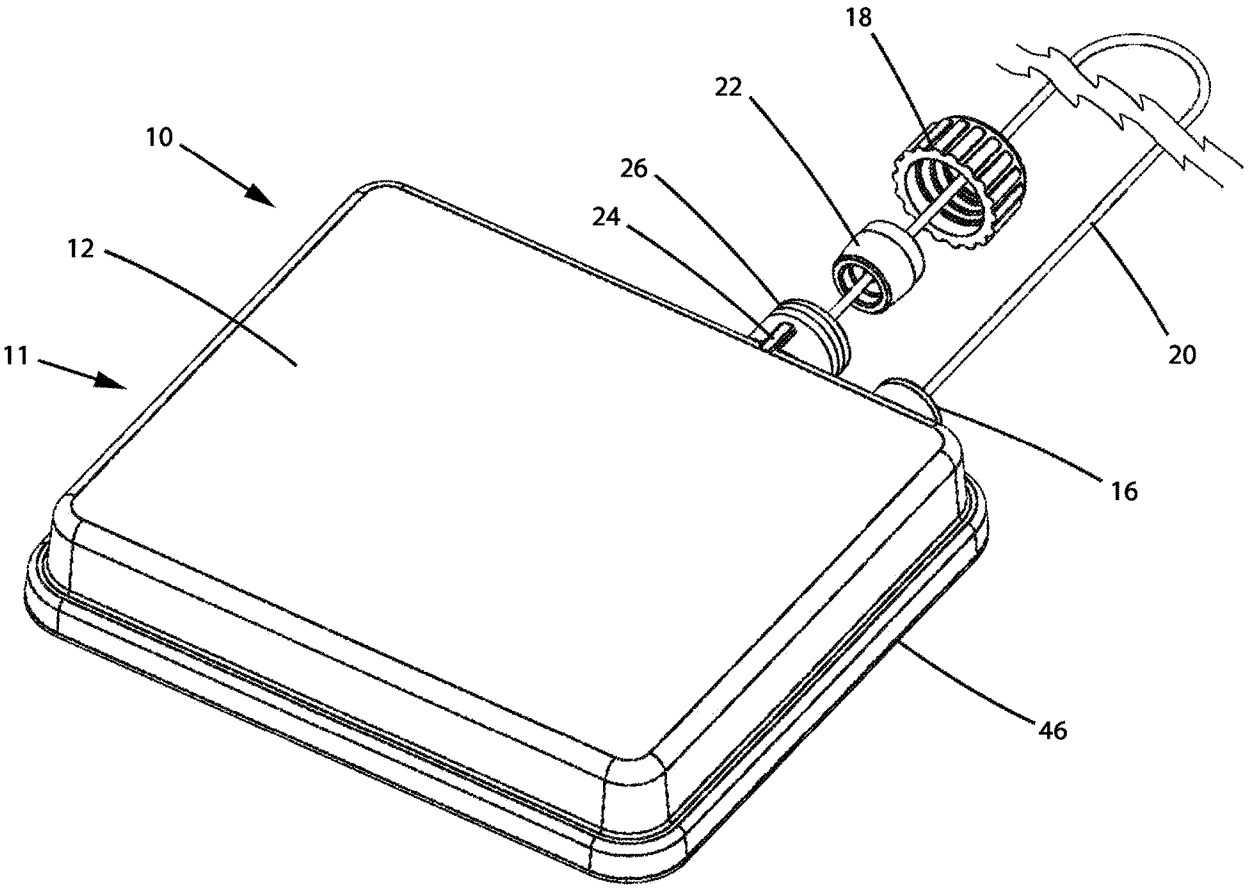
FIG. 2 shows a perspective view of the secure RFID tag with the threaded cap and compression seal removed.

FIGS. 1-5 show a secure passive RFID tag 10 which preferably comprises an enclosure 11 having an enclosure top 12 and an enclosure base 14, an antenna 30, an RFID printed circuit (pc) board 32, a fiber optic transmitter 34 providing means for transmitting an optical signal, a fiber optic receiver 36 providing means for receiving an optical signal, and a fiber optic cable 20. Preferably, the enclosure 11 completely contains all the secure passive RFID tag 10 elements except the majority of the fiber optic cable 20, where the cable ends are contained within the enclosure 11. At least a portion of the enclosure 11 is radio-transparent to permit radio signals to be received and transmitted externally by the antenna 30. Preferably the enclosure 11 is environmentally sealed, impact-resistant, and includes at least one means for attaching the tag 10 to objects for monitoring. Such objects are typically containers or portions of containers. The enclosure top 12 is preferably formed of an injection molded radio-transparent polymer such as polycarbonate, and the enclosure base 14 is preferably formed of a lightweight, strong metal such as aluminum.

Figure 6:
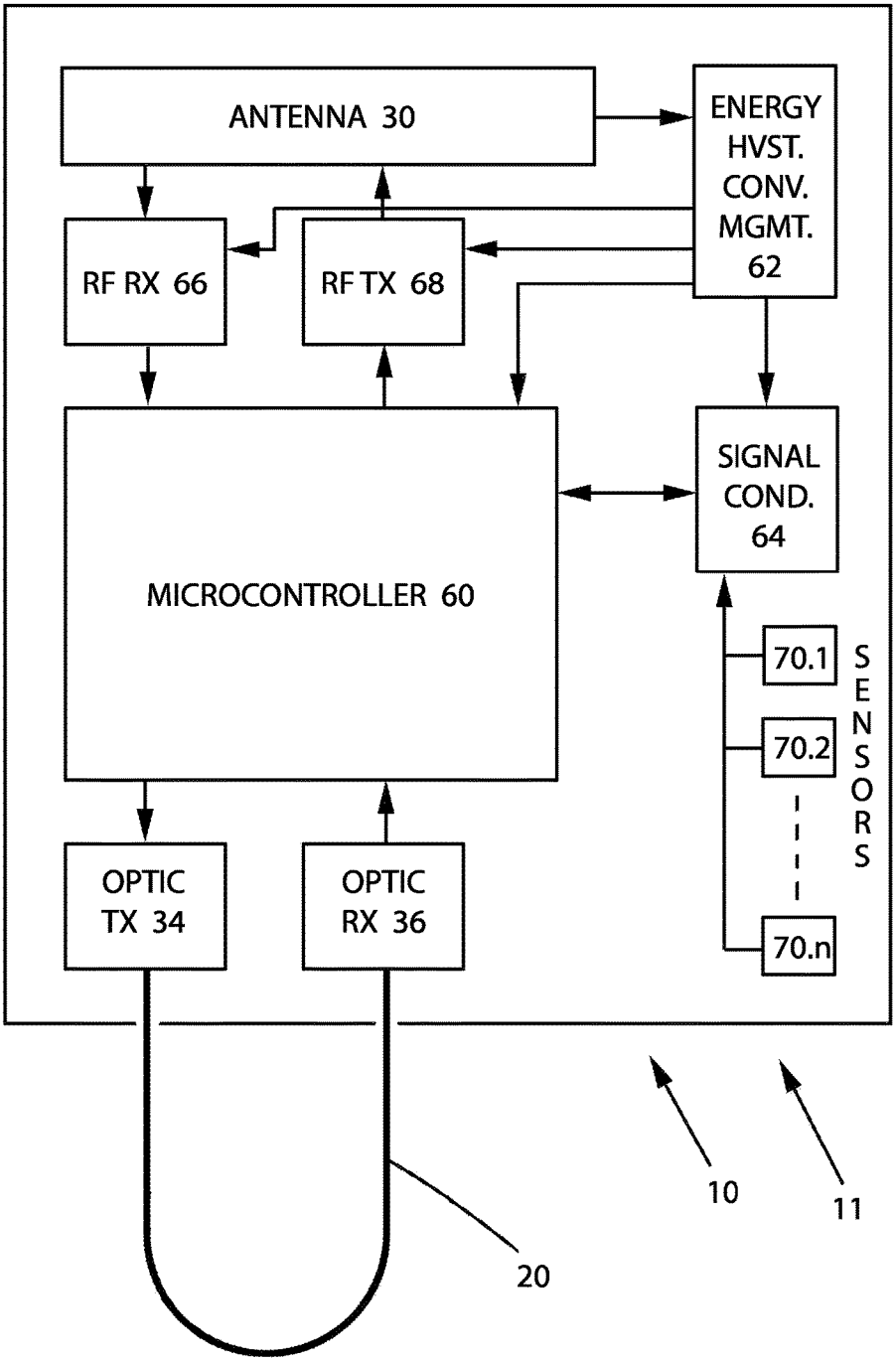
FIG. 6 shows a block diagram of the secure RFID tag electronic and optical system.

FIG. 6 shows the circuit blocks of the tag 10 including antenna 30, energy harvesting, conversion and management circuitry 62, radio receiver circuitry 66, radio transmitter circuitry 68, microcontroller 60, fiber optic transmitter 34, fiber optic receiver 36, and fiber optic cable 20. The tag 10 is configured to receive radio signals from at least one base station (not shown) and to transmit radio signals to at least one base station. The base stations may be fixed devices or mobile devices including handheld devices, or a mixture of fixed and mobile devices. The tag 10 circuitry may include one or more sensors 70 of types and for parameters including but not limited to temperature, radiation, light level, humidity, vibration, acceleration, and gyroscopic orientation. Additional circuitry may also include signal processing and conditioning circuitry 64 configured to process and condition the signals produced by the sensors 70. Preferably, at least the energy harvesting, conversion and management circuitry 62, radio receiver circuitry 66, radio transmitter circuitry 68, microcontroller 60, signal processing and conditioning circuitry 64, and one or more sensors 70 are configured on the RFID pc board 32. It is within the scope of the present invention for one or more of these circuit blocks to be located separately from the RFID pc board 32 within the enclosure 11.

In some embodiments, the energy harvesting, conversion, and management circuitry 62 may comprise an energy harvesting circuit to convert incoming radio frequency energy to direct current power for the device. In some embodiments the energy harvesting circuitry may comprise a rectifier composed of one or more type HSMS-2850, HSMS-2862, or other Schottky diodes manufactured by Avago Technologies or other companies. In further embodiments a voltage regulator such as a low dropout regulator (LDO) serves to limit the output voltage of the rectifier to a suitable voltage to run the other circuitry, such as 2.5 V or another DC voltage. In further embodiments, one or more capacitors are connected to the rectifier and/or voltage regulator output and are used to store energy to continue the operation of the tag 10 during a momentary decrease of the incident RF power, for example during a frequency hopping of the incident RF power.

The radio receiver circuitry 66 provides means for converting incoming radio signals into signal data usable by the tag 10. In some embodiments, the radio receiver circuitry 66 may comprise an envelope detector. This envelope detector may be implemented with one or more Schottky diodes such as the type HSMS-2850 series or HSMS-2862 series from Avago Technologies, or the type BAS70 or equivalent from NXP Inc. In other embodiments the envelope detector may be implemented with diode-connected field effect transistors (FETs). In further embodiments the radio receiver circuitry 66 may include a comparator circuit which compares the envelope detector output voltage to a reference voltage to yield a digital output for processing by the microcontroller 60. In some embodiments the reference voltage is derived from a low-pass filtered version of the envelope detected signal to yield a smoothed reference that tracks an average of the envelope detected voltage.

The radio transmitter circuitry 68 provides means for converting tag 10 output data into transmitted radio signals. In some embodiments, the radio transmitter circuitry 68 may comprise a backscatter modulator. In some embodiments the backscatter modulator may comprise a radio frequency switch configured to present a variable impedance to the antenna in response to a control signal from the microcontroller 60. This radio frequency switch may comprise one or more field effect transistors (FETs) or bipolar transistors connected to the antenna. In one embodiment the radio transmitter circuitry 68 comprises a type BF-1212 FET manufactured by NXP Inc. In other embodiments an RF switch such as the type ADG918 from Analog Devices Inc. may provide the switching function. In further embodiments the components of the radio transmitter circuitry 68 may be integrated on the same integrated circuit substrate as at least one of the radio receiver circuitry 66, the microcontroller 60, and/or the energy harvesting, conversion, and management circuitry 62.

In some embodiments, the signal processing and conditioning circuitry 64 comprises an analog-to-digital converter. In some embodiments, the analog-to-digital converter is integrated with the microcontroller 60. In further embodiments the analog-to-digital converter is multiplexed among multiple sensors 70.1, 70.2, etc.

In a further embodiment, some or all of the radio receiver circuitry 66, the radio transmitter circuitry 68, and the energy harvesting, conversion, and management circuitry 62 may be integrated into a single chip such as the type UCODE I2C integrated circuit, part number SL3S4011_4021, manufactured by NXP Inc. Alternatively, a custom application specific integrated circuit (ASIC) may integrate one or more of these functions, with the optional integration of the microcontroller 60.

Figure 3:
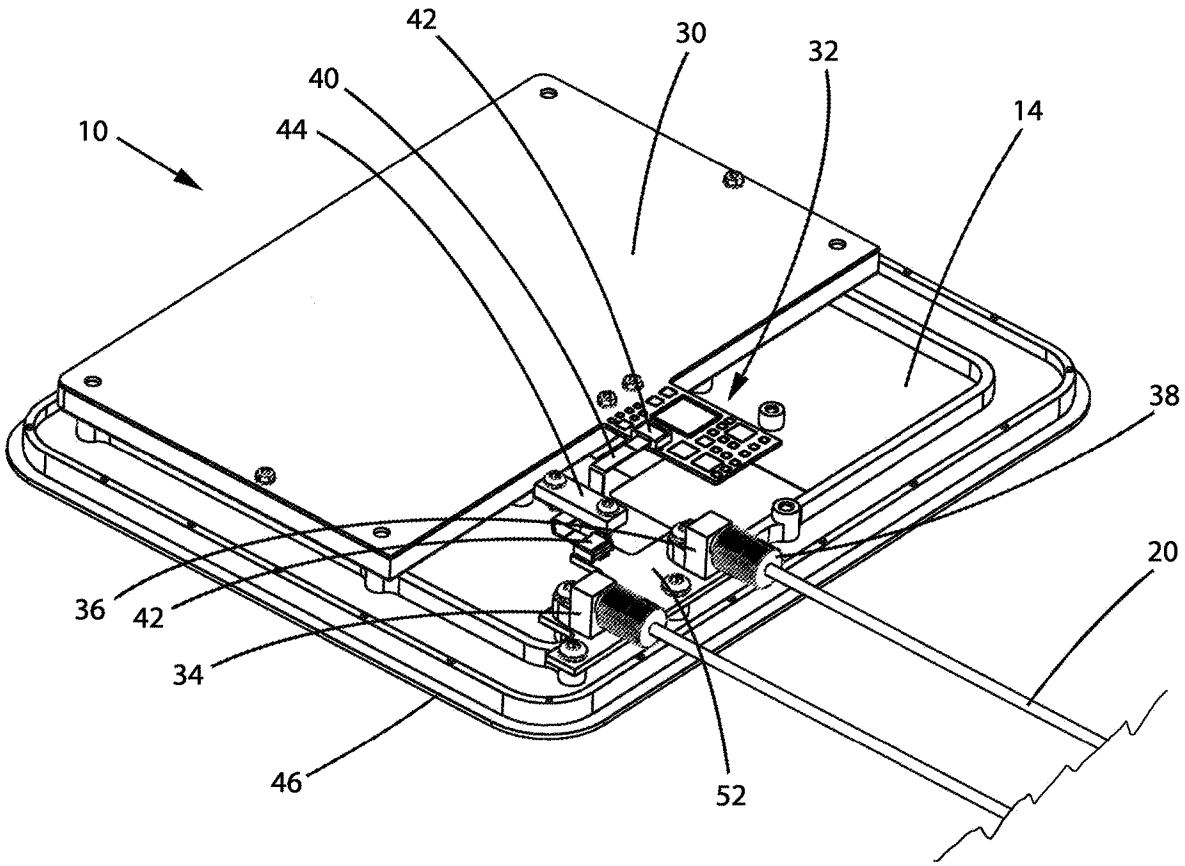
FIG. 3 shows a perspective view of the secure RFID tag with the enclosure top, cable caps and a portion of the antenna assembly removed.

The tag 10 contains no batteries and is powered exclusively by received radio energy. FIG. 3 shows the antenna 30 which is electrically connected to the RFID pc board 32, wherein the energy harvesting, conversion and management circuitry 62 rectifies the radio signal energy received from the antenna 30 and stores it as a voltage suitable for powering the microcontroller 60 and other circuitry within the tag 10 through at least one cycle of decrypting the received signal, processing received sensor data, transmitting an optical signal along the fiber optic cable 20, receiving the fiber optic signal, comparing the transmitted and received optical signals, and transmitting a signal back through the antenna 30. The antenna 30 is also connected to the radio receiver 66 and radio transmitter 68 circuitry. The antenna 30 is preferably a parasitic patch type antenna with a transmission range of at least 6 meters. Preferably, the tag 10 is capable of receiving and transmitting radio signals while attached to a metal substrate of substantially greater area than the area of the tag 10.

The microcontroller 60 is powered through the energy harvesting, conversion and management circuitry 62, and is connected to the radio receiver 66 and radio transmitter 68 circuitry. The microcontroller 60 is also connected to the fiber optic transmitter 34 and fiber optic receiver 36, which are linked via the fiber optic cable 20. Optionally, the microcontroller 60 may receive inputs from sensors 70, either directly or through analog and/or digital signal processing and conditioning circuitry 64. While it is within the scope of the present invention for the control element to be a microprocessor, a microcontroller 60 is preferred.

FIGS. 2-5 show further details of the fiber optic cable 20. The secure passive RFID tag 10 is preferably provided with the fiber optic cable 20 permanently attached to the fiber optic transmitter 34 and environmentally sealed to the enclosure 11 with the transmitter cap 16 and adhesive. In this condition the enclosure 11 is then permanently affixed to a portion of an object such as a container, and the fiber optic cable 20 is attached as required to the container. The fiber optic cable 20 functions as a frangible security cable and may typically be fastened to or wrapped around a container opening and/or through a locking hasp, such that any attempt to open the container will result in damaging, breaking or severing the fiber optic cable 20 and thus detectably altering the optical signal transmitted through the fiber optic cable 20. The cable 20 is preferably then field-inserted into the fiber optic receiver 36 and mechanically fastened into the receiver 36 to form a loop, after which a threaded receiver cap 18 and compression seal 22 are used to environmentally seal the cable entry point, so that both ends of the fiber optic cable 20 are environmentally sealed within the tag 10. The compression seal 22 is typically shaped to be a conically tapered cylinder with an axial hole which is only incrementally wider than the outer diameter of the fiber optic cable 20. The receiver cap 18 has a similarly sized axial hole. The compression seal 22 is preferably made of an elastomeric material and is pressed into an inwardly tapered entry aperture 48 in the enclosure 11 by the receiver cap 18 in order to compress the compression seal 22 around the fiber optic cable 20 and against the entry taper and thus form the environmental seal. Once the fiber optic cable 20 has been attached into the fiber optic receiver 36, the tag 10 can then send and receive optical signals.

Figure 4:
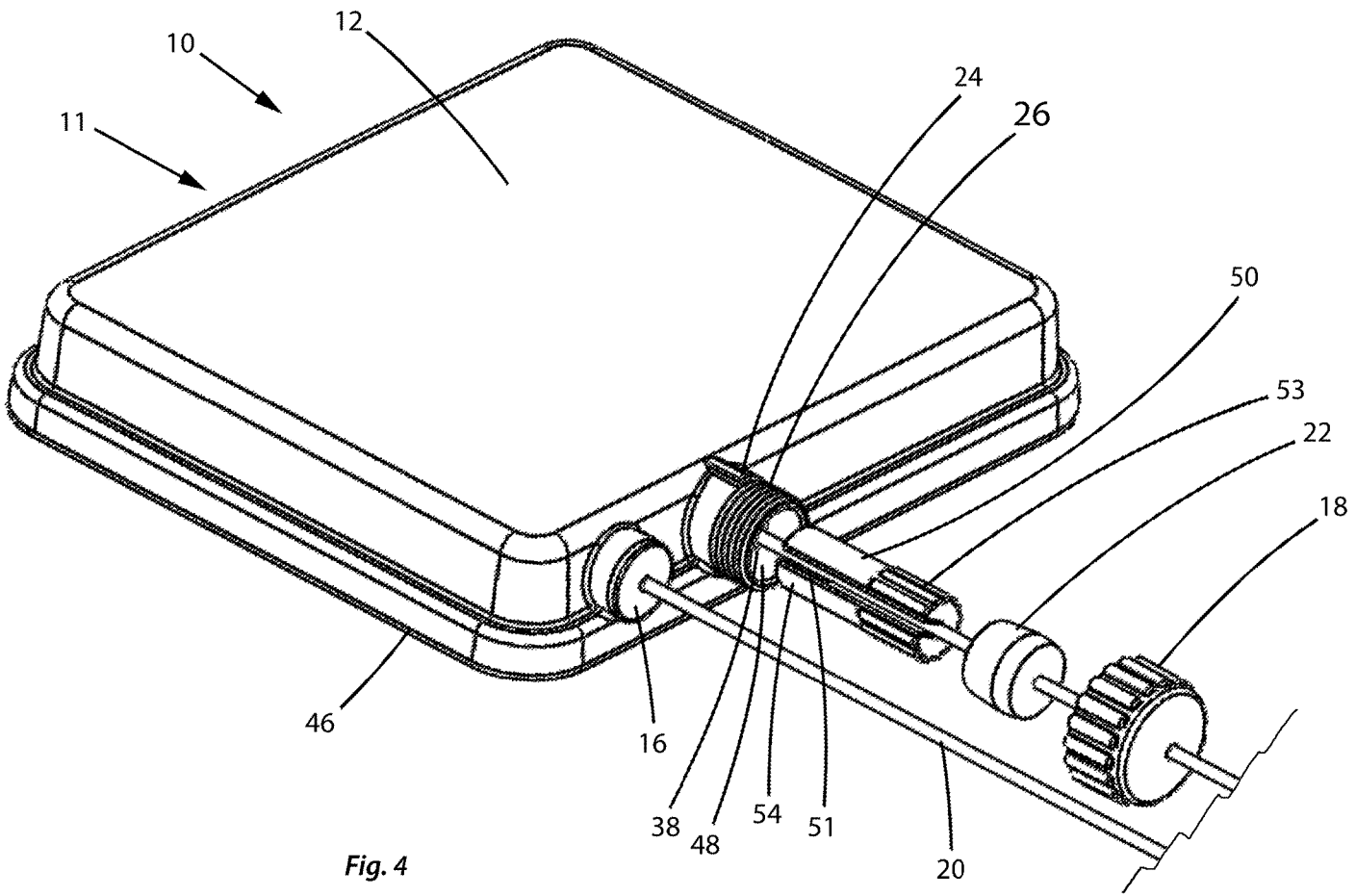
FIG. 4 shows a perspective view of the twist-lock tool threaded onto the fiber optic cable.
Figure 5:
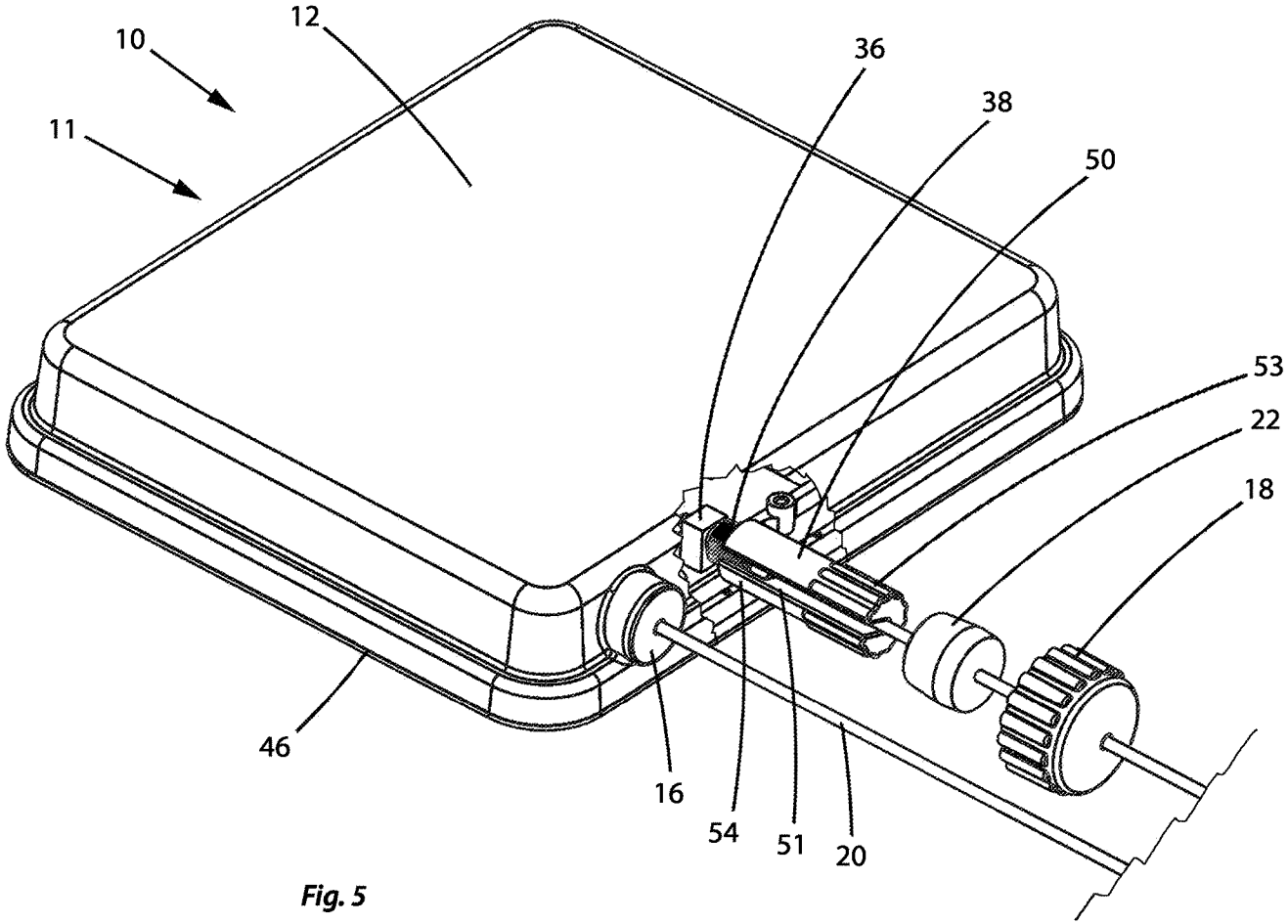
FIG. 5 shows a perspective cutaway view of the twist-lock tool in use.
Figure 8A:
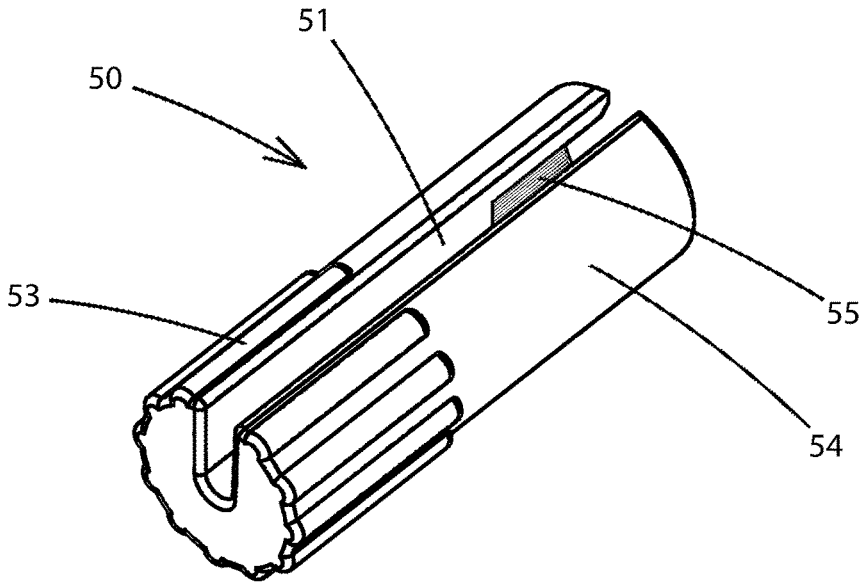
FIG. 8*a* shows a back perspective view of a twist-lock tool.
Figure 8B:
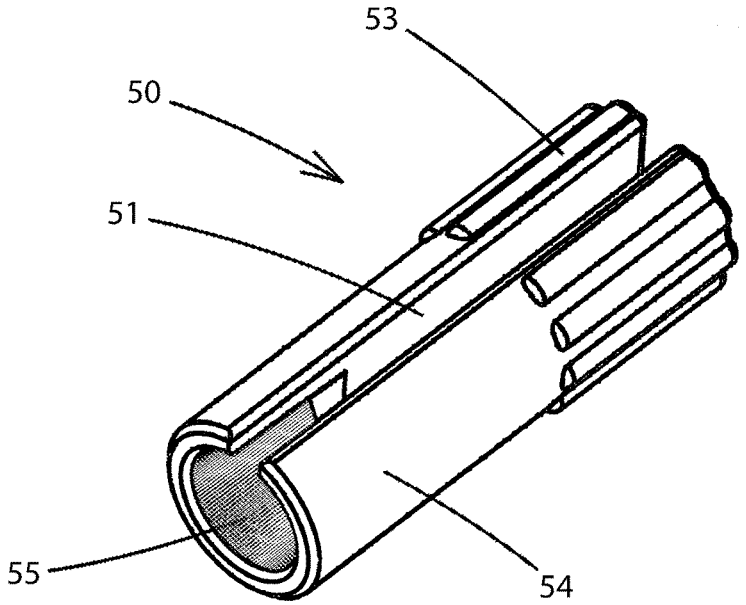
FIG. 8*b* shows a front perspective view of a twist-lock tool.

In the present invention, the preferred type of fiber optic transmitter 34 and fiber optic receiver 36 are both mounted on a secondary pc board 52 connected to the RFID printed circuit board 32 with a flat flexible multi-wire cable 40. The same functionality may be achieved with a unitary pc board, or with separate pc boards for each of the fiber optic transmitter 34 and fiber optic receiver 36. The flat flexible cable 40 is terminated at each pc board in a flat cable connector 42, and is positioned and strain relieved in the middle by a clamp bar 44. The microcontroller 60 and related RFID circuitry occupying the RFID pc board 32 are preferably located in proximity to the antenna 30, while the optical transmitting and receiving components are preferably located in a portion of the enclosure 11 where mechanical attachment features and environmental sealing features for the fiber optic cable 20 are easiest to form and use. The fiber optic transmitter 34 and receiver 36 each have a hollow threaded barrel 38 containing a twist-lock compression feature to lock an inserted fiber optic cable 20 in place. The barrels 38 have knurled and slightly conically tapered exteriors for easy hand tightening and loosening. The barrels 38 may also at least partially comprise grip enhancing features such as conical portions, ridges, knurls, high-friction texture, conformal material, and high-friction material, used singly or in combination. The twist-lock feature provides repeatable and reversible compressive retention of the fiber optic cable 20. The fiber optic cable 20 is inserted into the transmitter 34 barrel and hand tightened during assembly. It is also within the scope of the present invention to first assemble the fiber optic cable into the receiver 36, and then to field-insert the fiber optic cable into the transmitter 34, with the mechanical details of the tag 10 consequently accommodating such a variation. In the enclosure 11 of the present invention, both the transmitter 34 and the receiver 36 are recessed inside the enclosure 11, where an aperture 48 in the side of the enclosure 11 provides access for the fiber optic cable 20 to the receiver 36. As can be seen in FIGS. 4-5, while the barrels 38 were designed for hand-tightening, when located inside the aperture 48 it is not possible to tighten or loosen a barrel 38 by hand. Field insertion and tightening of the cable 20 into the receiver 36 is facilitated by a special twist-lock tool 50 as shown in FIGS. 8*a*-8*b*, which is employed to reach inside the aperture 48 and grasp the knurled exterior of the receiver 36 without interfering with or damaging the fiber optic cable 20. The tool 50 as shown is preferably cylindrical in form, with a radially oriented longitudinal slot 51 penetrating to the cylinder's central axis and thus rendering at least a portion of the central axis substantially hollow. The slot 51 is at least slightly wider than the diameter of the fiber optic cable 20, such that the fiber optic cable 20 may be inserted into the slot 51 and the tool 50 rotated axially without damaging or distorting the fiber optic cable 20. The tool 50 has a handle 53 which is preferably knurled or otherwise configured for improved finger gripping, and an engaging end 54 having an internal surface 55 configured for positive engagement and mutual grip enhancement with the barrel 38. This positive engagement may be simply a negative version of the barrel 38 contours, or may at least partially comprise grip enhancing features such as conical portions, ridges, knurls, high-friction texture, conformal material, and high-friction material, used singly or in combination. Preferably, the engaging end 54 is only slightly narrower than the aperture 48 for the receiver 36, and the barrel 38 is approximately coaxial with the aperture 48. It is within the scope of the present invention for the slot 51 to traverse only the engaging end 54 portion of the cylindrical length, although that would require some manipulation of the fiber optic cable 20 during rotation of the tool 50. It is also within the scope of the present invention for one skilled in the art to use other common fastening and strain relief mechanical means to attach the fiber optic cable 20 to the fiber optic transmitter 34 and receiver 36.

The preferred fiber optic cable 20 has a poly methyl methacrylate (PMMA) optical core surrounded by a polymer jacket, with an overall OD of approximately 2.2 mm. One significant advantage of this style of fiber optic cable 20 is the ease with which the open cable end may be prepared for insertion and use by simply trimming it at right angles with a razor blade. No polishing or other specialized preparation is required, which is ideal for field use. Since the desired length of cable is not likely to exceed approximately 5 meters, the signal attenuation of the PMMA cable with a hand-trimmed end is not an impediment to use. This style of fiber optic cable 20 is specifically not armored, where the lack of armor results in the fiber optic cable 20 having a relatively small bend radius which aids in installation and in following contours of the container, and also being sufficiently easily damaged or severed if tampered with. Another significant advantage of the preferred fiber optic cable 20 is that in the process of being field-inserted it can thus be easily field-trimmed to an optimal length to prevent the sort of tampering that an excessively long security cable could permit. Once the fiber optic cable 20 has been attached to, around or through features of the container being monitored, any excess cable length may be trimmed prior to insertion into the fiber optic receiver.

The RFID antenna 30 is preferably of the parasitic patch type and is used to both collect radio energy and the radio signals, and to transmit radio signals. Preferably, both the radio signal transmitted to the tag 10 and the radio signal transmitted by the tag 10 are encrypted. The encrypted information content of the received signal is decrypted by the microcontroller 60, which also encrypts the transmitted signal. Preferably, the transmitting range of the tag 10 is at least 6 meters.

The wireless link between the tag 10 and the base station is preferably a modulated-backscatter link using binary phase shift keying (BPSK) though any modulation scheme (ASK, PSK, QAM, OFDM, etc.) known in the art may be employed. The fiber optic transmitter 34 is preferably an infra-red transmitter such as an IR LED as or a laser diode. The fiber optic receiver 36 is preferably either a photodiode or phototransistor. The modulation used on the fiber link is preferably amplitude shift keying (ASK) although other modulation schemes known in the art may be employed. Preferably, the information content of the signal sent over the fiber optic link is a random number rather than encrypted information. However, it is within the scope of the present invention for the information content of the fiber optic signal to be a single bit of data, a relatively small number of bits of data, a random number, or an encrypted message such as an encryption of a clock/timer inside the tag. Authentication on the fiber link is necessary before the RFID transmission takes place. In other words, if the fiber link is broken, the wireless link will signal "not authentic". Therefore, tamper on the fiber link implies tamper on the seal itself.

The preferred means for attaching the enclosure 11 to a portion of a container or to any other object is with the use of adhesives. The enclosure 11 of the present invention includes very high bond (VHB) adhesive tape 46 attached to at least a portion of the enclosure base 14, enabling the enclosure 11 to be field attached to a clean and dry surface. The VHB tape 46 will provide an environmentally rugged permanent bond between the enclosure 11 and the surface. If appropriately configured, the VHB tape 46 may also provide an environmentally sealed bond between the enclosure 11 and the surface. The enclosure top 12 and enclosure base 14 are preferably attached to each other with an environmentally rugged adhesive such as an epoxy or a urethane compound.

In the preferred mode of use, the secure RFID tag 10 of the present invention is first attached to a portion of a container with the VHB tape 46. The fiber optic cable 20 is then preferably attached to or wrapped around container features, and/or threaded through openings to produce a seal. Once the fiber optic cable 20 is fully engaged with the container features, excess cable may be trimmed off. The receiver cap 18 and compression seal 22 are removed from the enclosure top 12 and threaded onto the cable 20. The receiver cap 18 is preferably internally threaded and configured to be fastened onto a threaded tube 26 which protrudes from the side of the enclosure top 12. This threaded tube 26 forms the outer bounds of the aperture 48 through which the receiver 36 may be accessed. The twist-lock tool 50 is inserted into the aperture 48 so that the engaging end 54 may engage with the barrel 38 of the receiver 36, and twisted by the handle 53 to unlock the barrel 38. The fiber optic cable 20 end is then inserted through the slot 51 of the tool 50, and through the center of the barrel 38 until it is stopped by being fully inserted into the receiver 36. The handle 53 of the tool 50 is then twisted to rotate the barrel 38 to lock the cable 20 into the receiver 36. The compression seal 22 is then slid into place in the aperture 48 inside the threaded tube 26, and the receiver cap 18 is attached. Preferably, the receiver cap 18 is tightened until a mechanical stop 24 is reached, thus guaranteeing proper tightening of the receiver cap 18 while completing the environmental sealing of the fiber optic cable 20 into the enclosure 11 by actuating the compression seal 22, and thus completing the environmental sealing of the entire tag 10.

The base station can now transmit a radio signal to the secure passive RFID tag 10. The antenna 30 receives the radio signal, wherein the energy harvesting, conversion and management means 62 provides electrical energy from the radio signal to power the microcontroller 60 and other signal-related circuitry, and the radio receiver circuitry 66 provides the signal information to the microcontroller 60. The microcontroller 60 decrypts the base station signal, and then sends a signal to the fiber optic transmitter 34. The fiber optic transmitter 34 converts the electrical signal to an optical signal and transmits the optical signal through the fiber optic cable 20 to the fiber optic receiver 36, which converts the optical signal back to an electrical signal and sends the electrical signal back to the microcontroller 60. The microcontroller 60 compares the sent and received fiber optic cable 20 signals for being identical in information content. Optionally, the microcontroller 60 may also have calibration data for parameters including fiber optic signal amplitude and propagation time, and thus may also verify that the transmitted optical signal and the received optical signal match sufficiently for these parameters too, whereby the transmitted optical signal and the received optical signal are seen as being approximately identical. The means for comparing the transmitted and received optical signals is preferably incorporated into the microcontroller 60 but it is within the scope of the present invention for circuitry external to the microcontroller 60 to perform part or all of the signal comparison functions. If the fiber optic cable 20 signal is normal, then the microcontroller 60 will generate an encrypted affirmative reply indicating that all conditions are normal, which the radio transmitter 68 will then transmit through the antenna 30. Preferably, if the fiber optic cable 20 signal is not normal, thereby indicating possible tampering or container breach, then the microcontroller 60 will generate an encrypted reply indicating an alarm, which the radio transmitter 68 will then transmit through the antenna 30. The means for decrypting and encrypting signals are preferably provided by software programmed into the microcontroller 60.

The microcontroller 60 may also receive data from sensors 70 located within the tag 10, in order to provide more data about the environmental conditions within and around the tag 10. If the fiber optic cable 20 signal is normal and any sensor data is normal too, then the microcontroller 60 will generate an encrypted affirmative reply indicating that all conditions are normal, which the radio transmitter 68 will then transmit through the antenna 30. If the fiber optic cable 20 signal is not normal, thereby indicating possible tampering or container breach, or if any sensor data is not normal, then the microcontroller 60 will generate an encrypted reply indicating an alarm, which the radio transmitter 68 will then transmit through the antenna 30. The tag may also transmit preferably encrypted sensor data, so that computers and users monitoring the base station may interpret the sensor data.

Preferably, after initial attachment and activation, the receiver cap 18, compression seal 22, and fiber optic cable 20 may be removed and then reinserted and re-sealed into the tag 10 without damage in order to perform field service including container opening if necessary, with a means for authorizing a permitted opening and subsequent reattachment and reactivation of the fiber optic circuit without a resultant alarm signal. The means for authorizing a permitted opening and subsequent reattachment and reactivation is preferably governed by parameters including but not limited to length of time, specific time interval, the tag 10 receiving an authorization code, a base station receiving an authorization code, a physical key being used with the tag 10, and a physical key being used with a base station. Those skilled in the art of electromechanical design will recognize that there are a wide range of well-known options for implementing a function such as the means for authorizing a permitted opening and subsequent reattachment and reactivation, typically wherein the microcontroller 60 would receive an authorization command via hardware or software, wherein optionally a software authorization command received by the microcontroller would originate with a hardware or software authorization command received by the base station. It is also well known in the art for passive RFID tags to respond to special authorization codes that have been programmed into their instruction sets.

In an alternate embodiment of the invention, multiple base stations of any combination of fixed and mobile types may be networked together to cover a larger area or to communicate with the tag 10 from multiple vantage points.

Figure 7:
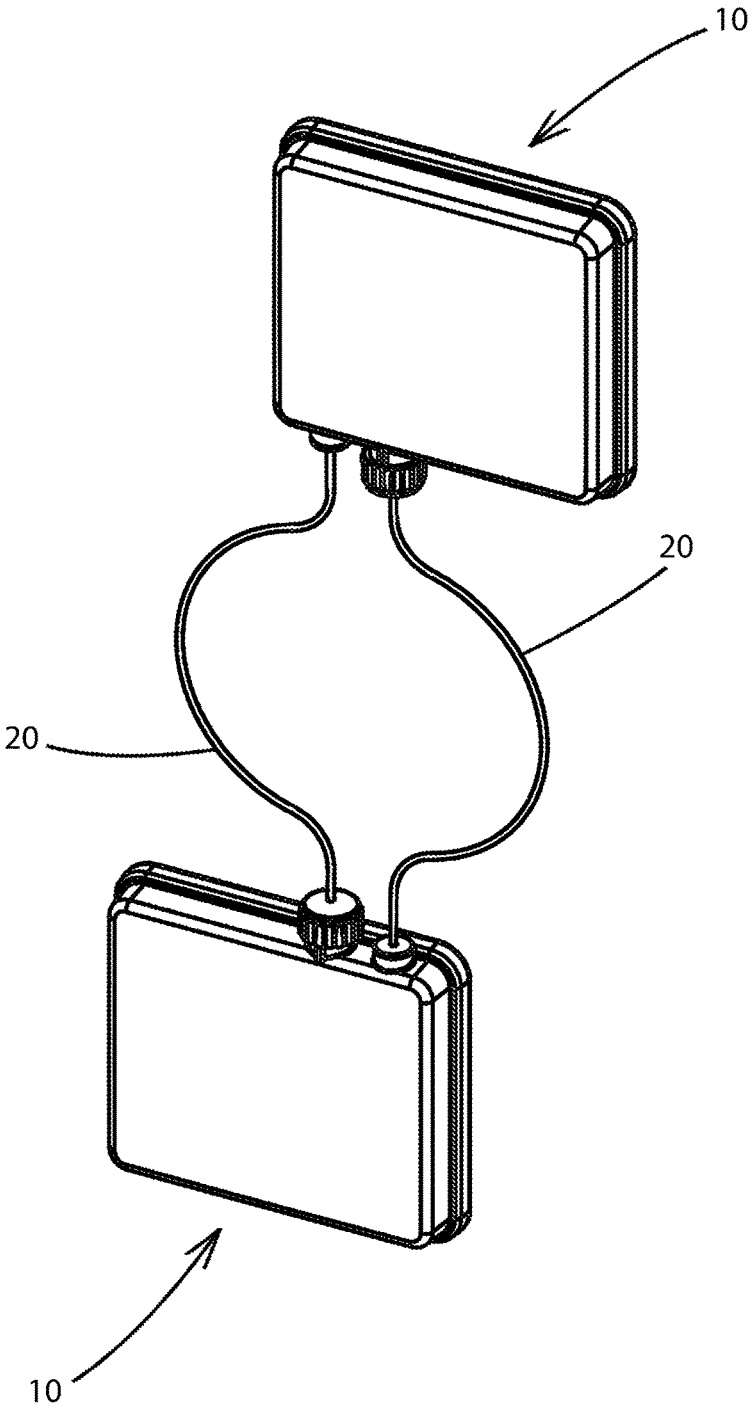
FIG. 7 shows a perspective view of two secure RFID tags with fiber optic cable, attached in a ring configuration.

In another alternate embodiment of the invention, the fiber optic transmitter 34, the fiber optic cable 20, and the fiber optic receiver 36 in combination form a fiber optic link, and the fiber optic link on one secure passive RFID tag 10 is interconnected to the fiber optic link in at least one other secure passive RFID tag 10, and signals can be passed along the fiber optic cables 20 in a ring. This is shown in FIG. 7.

It can be desirable to use a secure passive RFID tag 10 in applications with severe environmental conditions. One example of severe environmental conditions is an autoclave, where high temperatures and steam may be present. In yet another alternate embodiment of the invention, more environmentally rugged and high temperature resistant fiber optic cables may be employed, with cores made of materials such as high temperature resistant optical polymers, quartz and glass, and jackets made of materials such as high temperature resistant polymers and metals.

In still another alternate embodiment of the invention, an adhesive sealant may be added under the receiver cap 18 and around the compression seal 22 surrounding the fiber optic cable 20 to make the environmental seal permanent, such that any attempt to remove the fiber optic cable 20 will result in damage to the fiber optic cable 20.

In the above description of the secure passive RFID tag with fiber optic seal of this invention, various configurations are described and applications thereof in corresponding systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A secure passive RFID tag system comprising:

at least one base station;

at least one passive RFID tag said tag further comprising energy harvesting, conversion, and management circuitry, thereby enabling said tag to be powered exclusively by received radio energy;

said tag further comprising radio receiver circuitry for receiving radio signals from said base station and a backscatter modulator for transmitting radio signals to said base station;

said tag being capable of receiving and transmitting radio signals while attached to a metal substrate of substantially greater area than the area of said tag;

wherein said received radio signals are encrypted;

wherein said tag further comprises means for decrypting signals and encrypting signals;

wherein said transmitted radio signals are encrypted;

said tag having a transmission range of at least 6 meters;

said tag having a fiber optic cable comprising a first end, a second end, and a middle portion therebetween, wherein said first and second ends are fastened within said tag and said middle portion forms an external loop;

said loop adapted to be secured to, around, or through at least portions of an object;

said tag having a fiber optic transmitter for transmitting an optical signal having an information content through said fiber optic cable, and a fiber optic receiver for receiving said optical signal;

said fiber optic transmitter or receiver being recessed inside an aperture in said tag;

wherein said second end is insertable into said fiber optic transmitter or receiver through said aperture;

said fiber optic transmitter or receiver having a hollow threaded barrel for fiber optic insertion containing a twist-lock compression feature for aligning and retaining said second end;

a twist-lock tool configured for insertion into said aperture and engaging and actuating said hollow threaded barrel;

said hollow threaded barrel being configured for hand-tightening to actuate said twist-lock compression feature;

said hollow threaded barrel being inaccessible for hand-tightening within said aperture without the use of said twist-lock tool;

the actuating of said hollow threaded barrel and thus said twist-lock compression feature upon said inserted second end via said twist-lock tool thereby attaching said tag to an object by said loop;

said fiber optic cable being frangible and therefore easily damaged or broken in response to removal or tampering attempts, wherein said optical signal is detectably altered if said fiber optic cable is damaged or broken;

said tag transmitting said optical signal in response to receiving a radio signal from said base station;

said tag having means for comparing said transmitted optical signal to said received optical signal; and whereby if said transmitted optical signal and said received optical signal are approximately identical, said tag transmits an affirmative radio signal to said base station.

2. The secure passive RFID tag system of claim 1, wherein said tag includes means for attachment to an object, said means for attachment being in addition to said fiber optic cable.

3. The secure passive RFID tag system of claim 2, wherein said means for attachment is an adhesive.

4. The secure passive RFID tag system of claim 3, wherein said adhesive is an adhesive tape.

5. The secure passive RFID tag system of claim 1, wherein said tag includes an environmentally sealed enclosure.

6. The secure passive RFID tag system of claim 5, wherein said first and second ends are environmentally sealed within said tag.

7. The secure passive RFID tag system of claim 5, wherein said enclosure is at least partially formed of a radio transparent molded polymer.

8. The secure passive RFID tag system of claim 1, wherein if the information content of said transmitted optical signal and the information content of said received optical signal are not identical, said tag transmits an alarm radio signal to said base station.

9. The secure passive RFID tag system of claim 1, wherein said second end may be field inserted and environmentally sealed into said tag.

10. The secure passive RFID tag system of claim 9, wherein said second end may be removed and then reinserted into said tag without damage to said fiber optic cable.

11. The secure passive RFID tag system of claim 10, further comprising means for authorizing a permitted removal and subsequent reinsertion of said second end without a resultant alarm signal, wherein said means for authorizing said permitted removal and subsequent reinsertion includes but is not limited to parameters selected from a group consisting of length of time, specific time interval, said tag receiving an authorization code, said base station receiving an authorization code, a physical key being used with said tag, and a physical key being used with said base station.

12. The secure passive RFID tag system of claim 9, wherein said second end is permanently inserted and sealed into said tag such that any attempt to remove said fiber optic cable will cause damage to said fiber optic cable.

13. The secure passive RFID tag system of claim 1, wherein said hollow threaded barrel is at least partially tubular with an outer surface at least partially comprising grip enhancing features selected from a group consisting of conical portions, ridges, knurls, high-friction texture, conformal material, and high-friction material.

14. The secure passive RFID tag system of claim 13, wherein said twist-lock tool further comprises:

a substantially cylindrical body having a center axis, a handle end and an engaging end;

a longitudinal slot traversing at least said engaging end portion of said body, said slot having a width greater than the diameter of said fiber optic cable and a depth encompassing said center axis, thereby rendering at least a portion of said center axis substantially hollow;

said engaging end having an outer diameter less than the width of said aperture;

said engaging end having an internal surface at least partially comprising grip enhancing features selected from a group consisting of conical portions, ridges, knurls, high-friction texture, conformal material, and high-friction material;

said grip enhancing features of said engaging end and said grip enhancing features of said hollow threaded barrel being sufficiently matched to provide mutual grip enhancement; and whereby said twist-lock tool may be held by said handle end and used to grip and engage said hollow threaded barrel in order to lock or unlock said second end at said optical transmitter or receiver without interfering with or damaging said optical fiber.

15. The secure passive RFID tag system of claim 1, wherein said fiber optic cable is not armored, thereby increasing tamper sensitivity and facilitating field-trimming to a desired final length in order to optimize secure attachment and to reduce the risk of accidental damage or successful tampering via excess cable length.

16. The secure passive RFID tag system of claim 15, wherein said fiber optic cable at least partially comprises a poly methyl methacrylate optical core.

17. The secure passive RFID tag system of claim 1, wherein said fiber optic cable is an environmentally rugged and high temperature resistant fiber optic cable at least partially comprising:

an optical core made from materials selected from a group consisting of high temperature resistant optical polymers, quartz, and glass; and a jacket made from materials selected from a group consisting of high temperature resistant polymers and metals.

18. The secure passive RFID tag system of claim 1, wherein said tag further comprises a microcontroller or microprocessor.

19. The secure RFID tag system of claim 1, wherein said optical signal comprises an infra-red signal.

20. The secure passive RFID tag system of claim 1, wherein said optical signal information content comprises data selected from a group consisting of a single bit of data, a relatively small number of bits of data, at least one random number, and an encrypted message such as an encryption of a clock/timer signal.

21. The secure passive RFID tag system of claim 1, wherein said tag further comprises a parasitic patch type antenna.

22. The secure passive RFID tag system of claim 1, wherein:

said at least one base station comprises multiple base stations;

said multiple base stations are selected from a group consisting of fixed base stations and mobile base stations; and said multiple base stations are networkable in order to increase geographic area coverage and allow communication with said tag from multiple vantage points.

23. The secure passive RFID tag system of claim 1, wherein:

said tag comprises multiple tags;

wherein said fiber optic transmitter, said fiber optic receiver, and said fiber optic cable in combination form a fiber optic link; and wherein a first fiber optic link in one of said tags is interconnected to at least a second fiber optic link in at least one other of said tags, whereby said optical signal is passed along said fiber optic cables in a ring.

24. The secure passive RFID tag system of claim 1, further comprising:

at least one sensor selected from a group consisting of temperature sensors, radiation sensors, light level sensors, humidity sensors, vibration sensors, accelerometers, and gyroscopes;

signal processing and conditioning circuitry configured for acting upon signals produced by said sensors; and wherein said tag transmits a radio signal comprising tamper status data and sensor data to said base station.

25. A secure passive RFID tag system comprising:

at least one base station;

at least one passive RFID tag;

said tag further comprising energy harvesting, conversion, and management circuitry, thereby enabling said tag to be powered exclusively by received radio energy;

said tag further comprising a microcontroller or microprocessor;

said tag further comprising a parasitic patch type antenna;

said tag being capable of receiving and transmitting radio signals while attached to a metal substrate of substantially greater area than the area of said tag;

said tag further comprising radio receiver circuitry for receiving encrypted radio signals from said base station, means for decrypting said received radio signals, means for encrypting radio signals, and a backscatter modulator for transmitting said encrypted radio signals to said base station;

said tag having a transmission range of at least 6 meters;

said tag further comprising signal processing circuitry and at least one sensor selected from a group consisting of temperature sensor, radiation sensor, light level sensor, humidity sensor, vibration sensor, accelerometer, and gyroscope;

said tag having a fiber optic cable comprising a first end, a second end, and a middle portion therebetween;

said tag further comprising a fiber optic transmitter for transmitting an optical signal having an information content through said fiber optic cable, and a fiber optic receiver for receiving said optical signal;

said optical signal being an infra-red signal;

said tag further comprising an environmentally sealed enclosure;

said enclosure being at least partially formed of a radio transparent molded polymer;

said enclosure having adhesive tape means for attachment to an object;

one of said fiber optic transmitter or receiver being recessed inside an aperture in said tag;

wherein said second end is insertable into said fiber optic transmitter or receiver through said aperture, thereby placing said second end in optical communication with said fiber optic transmitter or receiver;

said fiber optic transmitter or receiver having a hollow threaded barrel for fiber optic insertion containing a twist-lock compression feature for aligning and retaining said second end;

a twist-lock tool configured for insertion into said aperture and engaging and actuating said hollow threaded barrel;

said hollow threaded barrel being configured for hand-tightening to actuate said twist-lock compression feature;

said hollow threaded barrel being inaccessible for hand-tightening within said aperture without the use of said twist-lock tool;

said aperture further comprising an environmentally sealable port wherein said second end may be field inserted and environmentally sealed into said port;

wherein said first end is environmentally sealed within said tag and in optical communication with the other of said fiber optic transmitter or receiver;

whereby inserting said second end into said port forms said middle portion into an external loop;

said loop being adapted to be secured to, around, or through at least portions of an object, whereby said twist-lock tool engaging and actuating said hollow threaded barrel and thus said twist-lock compression feature upon said inserted second end thereby secures said loop, and thereby attaches said tag to an object;

said fiber optic cable being frangible and therefore easily damaged or broken in response to removal or tampering attempts, wherein said optical signal is detectably altered if said fiber optic cable is damaged or broken;

said tag transmitting said optical signal in response to receiving a radio signal from said base station;

said tag having means for comparing said transmitted optical signal to said received optical signal;

said tag determining a tamper status dependent upon whether said transmitted optical signal and said received optical signal are approximately identical; and whereby said tag transmits an encrypted radio signal comprising tamper status data and sensor data to said base station.

26. The secure passive RFID tag system of claim 25, wherein said optical signal comprises an encoded signal selected from a group consisting of a single bit of data, a relatively small number of bits of data, at least one random number, and an encrypted message such as an encryption of a clock/timer signal.

27. The secure passive RFID tag system of claim 25, wherein said second end may be removed and then reinserted into said aperture without damage to said fiber optic cable.

28. The secure passive RFID tag system of claim 27, further comprising means for authorizing a permitted opening and subsequent reattachment of said second end without a resultant alarm signal, wherein said means for authorizing said permitted opening and subsequent reattachment includes but is not limited to parameters selected from a group consisting of length of time, specific time interval, said tag receiving an authorization code, said base station receiving an authorization code, a physical key being used with said tag, and a physical key being used with said base station.

29. The secure passive RFID tag system of claim 25, wherein said second end is permanently inserted into said aperture such that any attempt to remove said fiber optic cable will cause damage to said fiber optic cable.

30. The secure passive RFID tag system of claim 25, wherein said fiber optic cable may be field-trimmed to a desired final length in order to optimize secure attachment and to reduce the risk of accidental damage or successful tampering via excess cable length.

31. The secure passive RFID tag system of claim 25, wherein:

said at least one base station comprises multiple base stations;

said multiple base stations are selected from a group consisting of fixed base stations and mobile base stations; and said multiple base stations are networkable in order to increase geographic area coverage and allow communication with said tag from multiple vantage points.

32. The secure passive RFID tag system of claim 25 wherein:

said tag comprises multiple tags;

wherein said fiber optic transmitter, said fiber optic receiver, and said fiber optic cable in combination form a fiber optic link; and wherein a first fiber optic link in one of said tags is interconnected to at least a second fiber optic link in at least one other of said tags, whereby said optical signal is passed along said fiber optic cables in a ring.

33. A method of using a secure passive RFID tag, comprising:

attaching at least one secure passive RFID tag having a fiber optic cable with a first end affixed within a first fiber optic connector disposed within said tag, a second end free, and a middle portion therebetween, to a surface of a container, said surface being of substantially greater area than the area of said tag;

securing said middle portion to, around or through at least one portion of at least one feature on said container;

inserting said second end into a second fiber optic connector disposed within an aperture in said tag, wherein said fiber optic connector includes a twist-lock compression feature configured for hand-tightening of said fiber optic connector around a fiber optic cable, but said aperture prevents hand-tightening of said fiber optic connector without the use of a twist-lock tool configured to reach within said aperture and engage said twist-lock compression feature of said second fiber optic connector;

securing said second end within said tag via the use of said twist-lock tool, thereby further attaching said tag to said container by said fiber optic cable;

encrypting a first signal at, at least one base station;

transmitting said encrypted first signal as a first radio signal from said base station to said tag over a distance of at least 6 meters;

receiving said first radio signal at said tag;

harvesting energy from said first radio signal at said tag;

converting said energy to DC voltage at said tag;

managing said DC voltage at said tag;

powering said tag via said DC voltage;

decrypting said encrypted radio signal at said tag;

transmitting an optical signal from one end of said fiber optic cable through said middle portion to the other end of said fiber optic cable;

receiving an optical signal at said other end;

comparing said transmitted optical signal to said received optical signal;

determining a tamper status of said fiber optic cable through the comparison of said transmitted optical signal and said received optical signal;

encrypting said tamper status;

transmitting said encrypted tamper status via a backscatter modulator as a second radio signal from said tag over a distance of at least 6 meters;

receiving said encrypted tamper status at said base station; and decrypting said encrypted tamper status at said base station.

34. The method of claim 33, further comprising:

trimming said second end to a desired length after securing said middle portion.

35. The method of claim 33, further comprising:

environmentally sealing said second end within said aperture.

36. The method of claim 33 wherein said optical signal transmitted from one end of said fiber optic cable is encoded or encrypted and said received optical signal is decoded or decrypted.

37. The method of claim 33, further comprising:

receiving sensor signals from sensors incorporated into said tag;

processing said sensor signals into sensor data;

transmitting said sensor data as a radio signal from said tag; and receiving said sensor data at said base station.

38. The method of claim 37, further comprising:

encrypting said sensor data;

transmitting said encrypted sensor data as an encrypted radio signal from said tag;

receiving said encrypted sensor data at said at least one base station; and decrypting said encrypted sensor data at said base station.

* * * * *